US006281417B1

(12) United States Patent
Ladao

(10) Patent No.: US 6,281,417 B1
(45) Date of Patent: Aug. 28, 2001

(54) MUSICAL INSTRUMENT DISPLAY STAND

(76) Inventor: Lawrence N. Ladao, 8811 Gilman Dr., G, La Jolla, CA (US) 92037

( * ) Notice: Subject to any disclaimer, the term of this patent is extended or adjusted under 35 U.S.C. 154(b) by 0 days.

(21) Appl. No.: 09/761,228

(22) Filed: Jan. 18, 2001

(51) Int. Cl.[7] ..... G10D 3/00

(52) U.S. Cl. ..... 84/327; 84/329; 84/421; 248/449; 211/85.6

(58) Field of Search ..... 84/327, 421, 329; 248/449, 451, 309.1; 211/85.6, 94.01, 94.02

(56) References Cited

U.S. PATENT DOCUMENTS 4,987,817 * 1/1991 Diaz ..... 84/421
5,063,821 * 11/1991 Battle ..... 84/723
5,492,228 * 2/1996 Botkin ..... 211/13
5,726,369 * 3/1998 Gilday ..... 84/327
5,957,417 * 9/1999 Yu ..... 248/166
5,959,225 * 9/1999 Hsu ..... 84/327
6,091,008 * 7/2000 Yu ..... 84/327
6,127,612 * 10/2000 Yu ..... 84/327

* cited by examiner

*Primary Examiner*—Robert E. Nappi
*Assistant Examiner*—Kim Lockett
(74) *Attorney, Agent, or Firm*—Donn K. Harms

(57) ABSTRACT

A musical instrument stand, for mounting and display of one or a plurality of musical instruments such as a guitar. The device features an elongated member that is either attachable to a wall or floor mounted. Instruments are mounted between a pair of upper and lower instrument mounts or clusters of mounting brackets, each having a rotatable support bars to contact the side of the guitar when the mounting brackets are slid toward each other on a slidable mount to the elongated member. Angled ends of the support bars restrain the instrument in the stand when the support bars are rotated to place the angled ends in front of the mounted instrument. Abrasion of the instrument surface is avoided using a slideable cushion on each support bar that insulates the instrument surface from the support bar during rotation. A lockable cover optionally prevents removal of the instrument from its mount without first unlocking the cover.

11 Claims, 2 Drawing Sheets

MUSICAL INSTRUMENT DISPLAY STAND

This invention relates to a modular display stand for holding and displaying musical instruments. More particularly it relates to a device for the secure removable mounting of multiple musical instruments, specifically but not limited to guitars and other instruments of a similar configuration. The device allows for such display in a horizontal fashion and features rotatable mounts which are insulated from friction upon the instrument during such rotation. Additionally, the device features the unique ability of being able to secure or as needed, lock, each instrument separately on the holding stand, and display a plurality of instruments in a fashion to allow buyers to view them in a natural or horizontal position.

BACKGROUND OF THE INVENTION

In the music industry, the act of holding and displaying expensive, fragile instruments, either in sales or by private collectors, has an inherent problem on how to securely hold several without scratching and still have them readily available. Additional problems arise when the instruments require being locked in place separately, for individual supervised handling.

In sales, display space is always at a premium, and with valuable and fragile string instruments, it is most common practice to retain these items behind locked, sliding glass doors which limit the display space available. Many times guitars are put on high shelves for display and to keep the patrons from readily handling them without supervision by a store employee. This practice makes it very difficult, especially for a short sales person, to get the instrument down for supervised handling. Private collectors on the other hand, do not always desire large display cabinets with sliding glass doors in their homes.

Conventional guitar holding devices currently available are generally made to hold one instrument only or for multiple instruments but lacking in adjustability and ease of use. Other multi purpose racks for hanging several objects do not provide a real means to adequately protect a fragile musical instrument, and fail to provide a means of locking or securing each item individually retained thereupon.

U.S. Pat. No. 5,301,823 of Carl D. Kingery teaches of an improved rack for ornamental display of a single instrument. The rack mounts against a vertical wall and is fully adjustable thereby accommodating instruments of varying neck widths, head sizes and orientations. While this rack handles a single instrument, it has no locking means, allows the guitar to swing like a pendulum, and fails to provide the protection necessary for the finish on an expensive instrument in that it displays it with a binding force at a single location of the neck.

U.S. Pat. No. 4,742,751 of Marc C. Cherry discloses an apparatus holding a guitar in a playing position that connects to the snap fasteners of the guitar body. The apparatus includes a bracket for receiving the strap fasteners and supports the instrument at the strap fasteners. The bracket is supported by a support part such that the instrument is held in a substantially horizontal playing position. This device has been developed to hold an instrument in a free standing position while the musician can stand or sit and play it, similar to the stand commonly used to hold the sheets of music. This device however, could not be readily used for storage or sales in that it could easily be knocked over by a customer, it requires strap fasteners, and there is no convenient locking means, nor is there any manner to secure the instrument in a mount that prevents abrasion to the exterior.

U.S. Pat. No. 5,083,729 (Ford) ET AL teaches a racking device that relates to a storage system for holding athletic equipment. More specifically, it provides a system for the storage of athletic equipment, such as bicycles, skis, and the like. This device, also being made from extruded aluminum, has been designed to carry a great deal of weight, possibly several bicycles, but does not incorporate any soft cushioning means required to prevent exterior abrasion to an expensive instrument like a guitar, it lacks adjustability, and also has no locking means that is easily removable during a short sale review.

U.S. Pat. No. 3,722,652 of Paul F. Busch ET AL is an invention directed in general to the storage and locking facilities and more particularly to a coin-operated rack for storing and locking skis. Though this has the capability of locking, it is specifically designed for skies and ski paraphernalia, and has no adaptive cushioning means and could not be reasonably adapted to hold and display multiple guitars.

U.S. Pat. No. 4,037,815 of Arthur D. DeLano teaches of a musical instrument support for holding an instrument on a wall-mounted bracket in an elevated position above the floor. The instrument support is detachable from the bracket, and is collapsible from a position in which it holds the instrument to a transport or storage position and is provided with scales to facilitate unfolding the instrument support to a desired size to accommodate a given instrument. This device has been designed to support and hold a single musical instrument on the wall with its face toward the ceiling where a customer cannot see it. Additionally it has no locking capability, no ability to hold more than a single instrument, and no means to cushion the exterior during mounting and removal.

U.S. Pat. No. 6,091,008 of Ming-Ti Yu describes an invention to provide a guitar hanger that has a hanging device to be rotated according to a center of gravity of the guitar hung on the hanging device. This invention is a simple rotatable rod assembly for hanging a single guitar on a wall, as in a pegboard attachment. It has no locking means and has no means to hold several instruments in a freestanding position.

As such, there is a continuing need for new and improved space saving device for storage and displaying guitars and similar articles for sale in music stores. Such a device should provide secure mounting of a plurality of instruments while concurrently providing easy removal and replacement of each individual instrument so mounted. Such a device should also provide protection for the delicate exterior of a guitar during removal and mounting. Further, such a device should be designed to provide both a retail sales display mount while concurrently providing private collectors with a device to store and protect their valued possessions in a locked or securely mounted environment.

SUMMARY OF THE INVENTION

The device as herein disclosed, overcomes the above-noted problems, and provides utility heretofore unavailable for the mounting, display, and storage of multiple stringed instruments such as guitars. The device is comprised of a central "X" shaped aluminum extrusion support members with a plurality of sets of holding and restraining units attached thereupon. This disclosed device also provides a lockable, soft cushioned mount for several fragile musical instruments concurrently. Additionally, the device provides the capability of being walls mounted on drywall or pegboard systems already in use, or it can be freestanding, with several instruments on both sides.

The in device its simplest configuration would provide a secure, easily removable mount for a guitar by the simple rotation of a support bar. In a more secure embodiment, guitars could be locked into place in their mounting positions using a unique locking mechanism.

In this simplest embodiment of the invention an "X" shaped aluminum extrusion will form the central supporting member. This "X" shaped extrusion has a distinct shape with two channels on both sides that mate with adjustable side mounting blocks. Also the unique shape of the "X" extrusion allows the head of a conventional carriage bolt to secure the mounting block being restrained, allowing them to move up and down, but will not rotate. A conventional wing nut is attached at the distal end of the carriage bolt which has been inserted through an orifice in the mounting block to hold it in position on the extrusion. Four mounting block assemblies form a cluster required to support and restrain each instrument on the display stand. Each mounting block has two bars translating through from the front of the block to the back, one being the angled support bar, and the other being the adjustable spacer bar. Each bar has the ability to translate within the mounting block to allow for different thickness' of instruments, then to be tightened with separate thumbscrews located at the top and bottom of the mounting block. Each bar has a soft cushioned end covering to guard against scratching. The angled support bar has an additional soft, cushioning tubular device that is enough larger than the diameter of the bar that it will rotate freely around the bar and further protect the instrument from damage. The mounting blocks are so aligned that two are above the instrument, and two are below, with the instrument held in a natural horizontal position, facing away from the stand. In this position it allows that no additional weight or force be added to the neck and strings of the instrument, and the weight is distributed throughout the body. The two mounting blocks at the top of the instrument will have the angular portion of the bar in the downward direction, restraining the instrument, while the two mounting blocks at the lower position will have the angular portion of the bar in the upward direction, supporting the instrument. There may be as many of the mounting block clusters holding instruments as the length of the "X" shaped extrusion will allow and depending upon the size of the instruments. In the wall mounted configuration, the display will be limited to one side of the extrusion only, but in a free standing display instruments may be placed on both sides of the extrusion allowing a great savings of display space. The free standing display stand will be supported by any conventional secure floor and ceiling mounting means.

An alternate embodiment of the device has a locking means which enables the mounting blocks to be locked in position, and the angled support and restraining bars therein, to also be locked such that they will not move in, out, or rotate. This locking ability provides a secure and locked mount for the instrument on the display stand and enhances security in a retail sales setting.

In this configuration the mounting has an upstanding flange to restrain the locking tab of the lock mechanism. The front and back of the mounting block have guides to restrain the cover box with the lock mechanism attached. When the cover box is in place it covers both the wing nut holding the mounting block in place, and the thumb screws holding the angled support bar and the adjustable spacer bar. A supportive tubular extension member with a raised, square key-like guide along its full length is placed over the angled support bar. An orifice matching in shape with the supportive tubular extension unit extends through the mounting block. This tubular member has a plurality of holes spaced along the key-like area adequately large enough for the thumbscrew to pass through, to tighten into a detent in the angled support bars. The soft, cushioning tubular insulator on the tubular support member will be large enough in diameter to adequately allow the tubular support member to rotate therein while cushioning the exterior of the instrument against the friction of rotation since it remains stationary in frictional engagement with the instrument.

It is therefor an object of this invention is to supply a Musical Instrument Stand that will securely hold and display one or a plurality of instruments.

Another object of this invention is to supply a Musical Instrument Stand that can be mounted on the wall or may also be freestanding with instruments mounted on both sides without interfering in their positioning.

Still another object of the invention is to support the instruments in a soft, cushioned environment, in a natural horizontal position facing the observer, and putting no additional strain on the neck and strings of the instrument.

A further object of the invention is to supply a Musical Instrument Display Stand that has the ability to lock each instrument separately.

A still further object of this invention is to provide a secure mount for a musical instrument such as a guitar that protects the fragile exterior of the guitar from abrasion and damage caused by the mount itself.

These together with other objects and advantages which will become subsequently apparent, reside in the details of the construction and operation as more fully hereinafter described and claimed, reference being had to the accompanying drawings forming a part hereof, wherein like numbers refer to like parts throughout.

BRIEF DESCRIPTION OF THE DRAWINGS

The accompanying drawings, which are incorporated in and form a part of this specification, illustrate embodiments of the invention and together with the description, serve to explain the principles of the invention.

DETAILED DESCRIPTION OF PREFERRED EMBODIMENTS OF THE DEVICE

Figure 1:
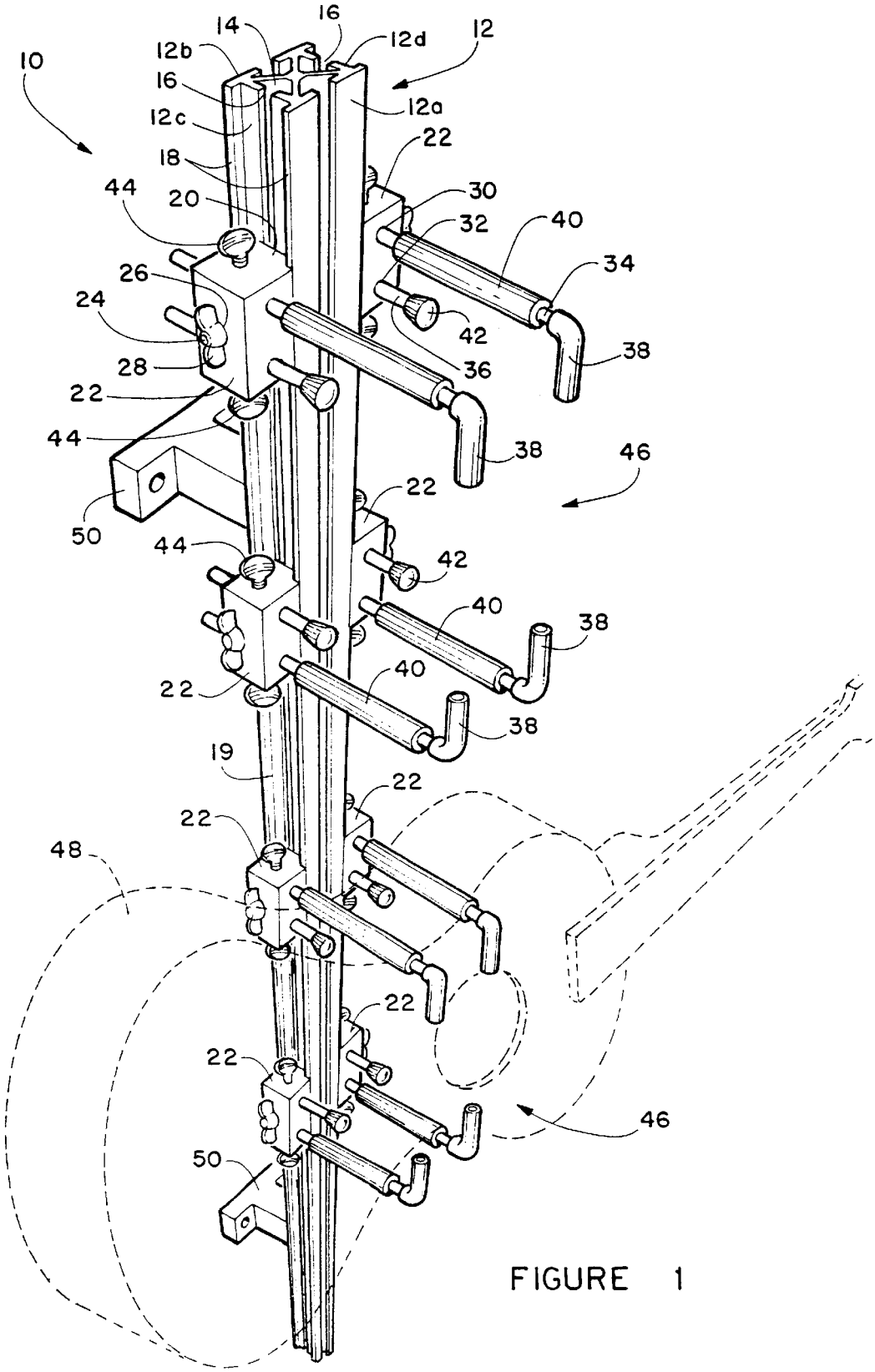
FIG. 1 depicts a perspective view of the simplest wall mounting configuration embodiment of the device, showing, but not limited to, two four-block mounting clusters for a single instrument with a typical guitar shown in phantom in the lower cluster.

Referring now to the drawing FIG. 1 showing the disclosed device 10 composed of the substantial "X" shaped aluminum extrusion member 12 with four central cavities 14 communicating with adjacent slots 16 translating throughout the full length of the elongated extrusion member 12. The front surface 12*a* and the back surface 12*b* are flat and may be ornamentally configured with colors or designs to enhance the display if desired. The sides 12*c* and 12*d* are configured with raised edges 18 which form a track 19 configured to receive a cooperatively shaped mating side 20 of the mounting block 22 for a secure means for slideable attachment of the mounting block 22 to the track 19.

The head portion 23 of a carriage bolt 24 is situated in the cavity 14 and communicates through the slot 16 and through aperture 26 communicating through the mounting block 22, thus allowing a means for slideable attachment of the mounting block 22 to the sides 12*c* and 12*d* which allows the mounting block 22 to be slidably positioned on the "X" extrusion and removably secured in a desired placement with wing nut 28, having the head 23 restrained from turning by cooperative engagement with slot 16.

Each mounting block 22 has an upper orifice 30, and a lower orifice 32 for insertion of the angled support bar 34, and the adjustable spacer bar 36 respectively. Of course the device might also be configured with a pair of single upper and lower mounting blocks 22 or instrument mounts, slidably locateable on the member 12, each having support bars 34 in an embodiment with less utility, and such is anticipated. However, the current best mode does feature four mounting blocks 22 to allow the most flexibility in the configuration to the odd shape of guitars and the like. The angled support bar 34 has on its angled outer end, a soft, cushioning cover 38, along with a soft cushion 40 having an inside diameter large enough to adequately allow it to rotate freely upon the angled support bar 34. This rotational ability of the cushion 40 on the angled support bar 34 thereby provides a means for insulation of the mounted instrument from contact with and abrasion from the rotation of the angled support bar 34. Such abrasion would commonly occur during mounting and dismounting of an instrument such as a guitar from the stand when the angled support bar 34 is rotated to allow the guitar to be pulled away from the member 12 and off of its mount on the angled support bar.

The adjustable spacer bar 36 has a soft, cushioned end 42 at the distal end of the spacer bar 36 to be positioned to contact and entrap the rear side instrument being held with the cushioned angled end of bar 34. While the spacer bar 36 is not necessary for the device to function better than currently available stands, and the rear of the instrument might be supported by the block 22, the inclusion of the spacer bar adds great utility when adjusting for thickness of the instrument as well as padding it against damages. Both the angled bar 34 and the spacer bar 36 are tightened into position by thumbscrews 44, positioned through threaded passages in the top and bottom of the mounting block 22, providing a communicating passage for the thumbscrews 44 to frictionally engage with bars 34 and 36.

To hold an instrument such as a guitar, would normally require four mounting blocks with the two upper mounting blocks 22 of the single instrument cluster 46 have the angled bars 34 with the angled ends turned down, in a restraining position above the spacer bar 36. While yielding less utility, a cluster could also be formed of an upper and lower mount that would be of a length sufficient to hold two angle bars 34 and two spacer bars 36, however the current best mode using four blocks slidably mounted yields more versatility and is preferred since the four blocks may slide to different locations versus just two. However it is anticipated that a two block version would be an improvement on present art and such is anticipated.

In the four block embodiment of a mounting cluster, the two lower mounting blocks 22 of the single instrument mounting cluster 46, have the angled bars 34 rotationally mounted with the angled end turned up in a supporting restraining position, below the spacer bar 36 which serves to hold the rear side of the instrument. To release a typical guitar 48, shown in phantom, the upper and lower thumbscrews 44, on the four mounting blocks 22 would be loosened by hand and all four of the angle bars 34 rotated to clear, for the removal of the instrument by pulling it away from the member 12 and out of contact with the four angle bars 34. In some cases, if the thumbscrews 44 are only tightened to provide a small amount of tension against the angle bars 34 the user can just twist and rotate the angle bar 34 to turn the angled distal end out of the way of the front of the instrument for removal. The thumbscrews 44 thus function as a means to restrain the rotation and lateral translation of the angle bars 34 and a means to restrain the lateral translation of the spacer bars 36. Of course other such means could be used such as allen screws, or spring loaded pins or the like, but the current best mode would use thumbscrews 44 for ease of use.

It is during this rotation of the angle bars 34 for mounting and dismounting the instrument, that the cushion 38 provides the means for insulation of the instrument interior from contact with the rotating support bars 34 and the resulting abrasion or other damage such rotation would cause to the surface of the instrument.

Mounting and remounting different instruments is further improved by the ability of both the angle bars 34 and spacer bars 36, to laterally translate in their mount to the blocks 22. By laterally translating the angle bar 34 toward or away from the distal end of the spacer bar 36, or the spacer bar 36 toward or away from the distal end of the angle bar 34, the user is given great latitude in mounting instruments of different dimensions since the lateral translation will provide great adjustability for the thickness of the instrument mounted between the spacer par 36 and the angel bar 34.

Attachment of the device 10 in a wall mounted environment such as currently used in music stores on pegboard or drywall, is depicted in FIG. 1 which shows the display stand device 10 with wall mounting blocks 50 conventionally attached to the "X" shaped aluminum extrusion member 12 using a bolt or by using a cooperatively engageable distal end of the mounting block 50 that will cooperatively engage the central cavity 14 on the rear surface 12*b* of the member 12 to hold the member in position when the mounting blocks 50 are secured to a wall surface.

Figure 2:
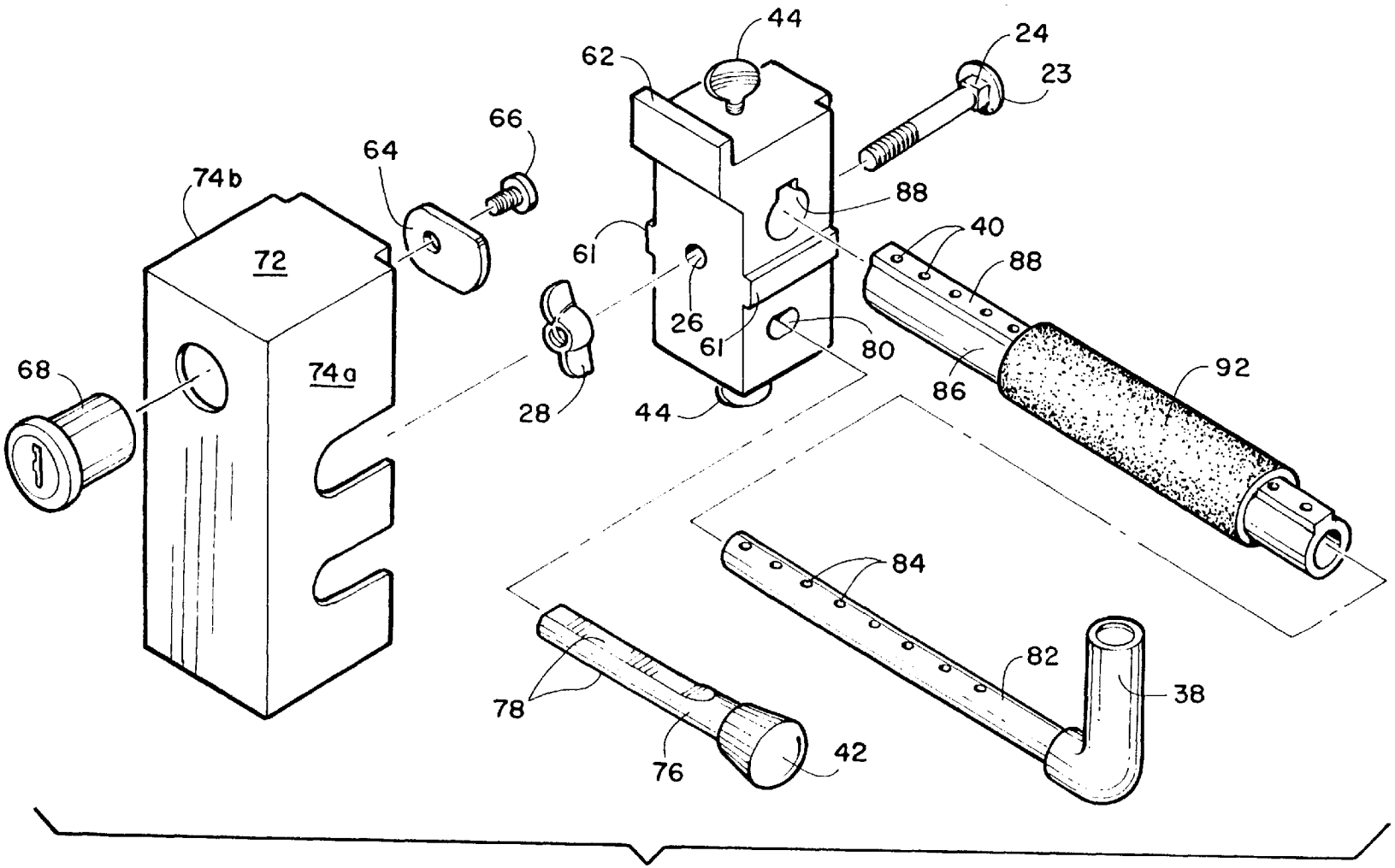
FIG. 2 depicts an exploded perspective view of the alternate preferred embodiment of the mounting block, with the locking box cover providing a locking means and the additional extension tubular support member.

FIG. 2, depicts an exploded view of the alternate preferred embodiment of the device 10 showing a mounting block configuration additionally having a means to lock the instrument in place in the mounting instrument cluster 46 configuration such that the instrument can only be removed with the help of a person with a key. This embodiment operates in the aforementioned fashion to hold an instrument in the cluster 46 and features the additional element of a lockable mounting block 60, with the same thumbscrews 44 on the top and the bottom, and the aperture 26 through the sides for the carriage bolt 24 that can be tightened onto the "X" shaped extrusion 12, by means of wing nut 28. The lockable mounting block 60 also retains the same side configuration mating within the track 19 formed by the raised edges 18, to restrain it from any rotational movement. Two guides 61 on the front and back of mounting block 60 align the cover box 72 into a fixed position. An upstanding flange 62 is located at the top of the mounting block 60 to engage the locking tab 64 attached by means of screw 66 to locking mechanism 68. The locking mechanism mounts through orifice 70 in cover box 72 that has slots 74 through the front side 74*a* and back 74*b* respectively. The lower slot 74 allows for the clearance of the spacer bar 76 with two flats 78 on opposite side corresponding with the orifice 80 with the same configuration in the mounting block 60. The angled support bar 82 has a similar configuration with the angle bend and the soft covering 38, but with a plurality of detents 84 in a straight alignment on the side adjacent to the angled bent up portion of the bar. The bar 82 translates within a tubular supportive extension member 86 that has a key-like guide 88 which in turn translates through an orifice 90 with the same configuration in the mounting block 60 and through the upper slot 74 in the cover box. The key-like guide 86 in the tubular supportive member 84, has a plurality of orifices 88, large enough for the thumbscrew 44 to pass through to tighten into one of the detents 84, in the angled support bar 82. The soft cushion 40 covers the tubular supportive extension member 86 with enough clearance that the cushioning device 92 can rotate freely in the aforementioned fashion to insulate the surface of the instrument from any damage or contact caused by such a rotation during mount and dismount.

By including the locking means, the instrument can only be dismounted by insertion of the proper key into the locking mechanism 68 to allow rotation of the locking tab 64 out of engagement with the mounting block so that the cover box 72 can be removed and allow access to allow loosening of thumbscrews 44 to allow removal of support bar 82 and thus removal of the instrument from a locked engagement in the cluster.

While all of the fundamental characteristics and features of the Musical Instrument Display Stand have been shown and described herein, it should be understood that various substitutions, modifications and variations may be made by those skilled in the field, without departing from the spirit of scope of the invention. Consequently, all such modifications and variations are included within the scope of the invention as defined by the following claims.

What is claimed is:

1. A musical instrument stand for attachment to a wall or a floor mount, comprising:

an elongated member, said elongated member having a front surface, a rear surface, a first side surface and a second side surface;

a front slot communicating with a central cavity along substantially the entire length of said front surface;

said first side surface having a pair of raised edges forming a first track on said first side surface, said track having a first side slot therein said first side slot communicating with a first side cavity;

said second side surface having a second pair of raised edges forming a second track on said second side surface, said second track having a second side slot therein said second side slot communicating with a second cavity;

at least one instrument mounting cluster attached to said elongated member said instrument cluster consisting of a pair of upper mounting blocks and a pair of lower mounting blocks;

said upper mounting blocks slidably mounted on said first side surface and said second side surface;

said lower mounting blocks slidably mounted on said first side surface and said second side surface;

each of said upper mounting blocks having an upper support bar, said upper support bar engaged in an upper orifice located in said mounting block, said upper support bar rotatable and laterally translatable in said orifice, said upper support bars positionable to engage the side surface of said musical instrument by slidably locating said upper mounting blocks on said first side surface and said second side surface;

means to adjustably restrain said upper support bar from lateral translation and rotation;

each of said lower mounting blocks having a lower support bar, laid lower support bar engaged at a first end with a lower orifice located in said lower mounting block, said lower support bar rotatable and laterally translatable in said lower orifice, said lower support bars positionable to engage the lower side surface of said musical instrument by slidably locating said lower mounting blocks toward said upper mounting blocks, on said first side surface and said second side surface;

means to adjustably restrain said lower support bar from lateral translation and rotation;

each of said upper support bars and said lower support bars, having an angled distal end, said angled distal end rotatable to a mounting position in front of a musical instrument to restrain it in said mounting cluster, said angled distal end rotatable to a removal position out of contact with said front of said musical instrument to allow removal of said musical instrument from said mounting cluster without having to adjust the distance between said upper mounting blocks and said lower mounting blocks; and whereby said musical instrument may be mounted to said stand by positioning said musical instrument between said upper support bars and said lower support bars and sliding said upper and lower support bars toward each other to contact the side of said instrument wherein said upper and lower support bars may be rotated to position their respective angled ends in front of the front surface of said musical instrument to retain said musical instrument on said stand.

2. The musical instrument stand as defined in claim 1 further comprising:

each of said upper mounting blocks having an upper spacer bar, laid upper spacer bar engaged at a first end with a spacer aperture located in said upper mounting block, said upper spacer bar laterally translatable in said spacer aperture; and each of said lower mounting blocks having an lower spacer bar, said lower spacer bar engaged at a first end with a spacer aperture located in said lower mounting block, said lower spacer bar laterally translatable in said spacer aperture.

3. The musical instrument stand as defined in claim 1 additionally comprising a means for insulation of said side surface of said musical instrument from contact with said upper and lower support bars during rotation of said upper and lower support bars.

4. The musical instrument stand as defined in claim 3 additionally comprising a means for insulation of said side surface of said musical instrument from contact with said upper and lower support bars during rotation of said upper and lower support bars.

5. The musical instrument stand as defined in claim 3 wherein said means for insulation of said side surface of said musical instrument from contact with said upper and lower support bars during rotation of said upper and lower support bars comprises an elongated cushion having an cushion aperture therethrough, said cushion positionable upon said upper and lower support bars by insertion through said cushion aperture, said cushion aperture having a diameter slightly larger than the diameter of the support bar therein inserted, whereby said cushion will remain in substantially motionless contact with said musical instrument when said support bar is rotated.

6. The musical instrument stand as defined in claim 1 additionally comprising a means to lock said instrument mounting cluster into engagement with said musical instrument.

7. The musical instrument stand as defined in claim 6 wherein said means to lock said instrument mounting cluster into engagement with said musical instrument comprises:

a cover box, said cover box cooperatively engageable over said mounting block;

said upper and lower support bars having fasteners communicating therewith, said fasteners positionable to prevent rotation of said upper and lower support bars;

said coverbox preventing access to said fasteners when cooperatively engaged with said mounting block;

a lock, said lock engageable through a sidewall of said cover box with said mounting block to a locked position preventing removal of said cover box from said mounting block;

said lock having an unlocked position out of engagement with said mounting block using a key; and said cover box being removable from cooperative engagement with said mounting block when said lock is in said unlocked position thereby allowing access to said fasteners.

8. A musical instrument stand comprising:

an elongated member, said elongated member having a front surface, a rear surface, a first side surface and a second side surface;

at least one instrument mounting cluster attached to said elongated member said instrument cluster consisting of an upper instrument mount and a lower instrument mount;

said upper instrument mount slidably mounted on said elongated member;

said lower instrument mount slidably mounted on said elongated member;

said upper instrument mount having at least one upper support bar, said upper support bar engaged in an upper orifice located in said upper instrument mount, said upper support bar rotatable in said orifice, said upper support bar positionable to engage the side surface of said musical instrument by slidably locating said upper instrument mount on said elongated member;

said lower instrument mount having at least one lower support bar, laid lower support bar engaged at a first end with a lower orifice located in said lower instrument mount, said lower support bar rotatable in said lower orifice, said lower support bar positionable to engage the lower side surface of said musical instrument by slidably locating said lower instrument mount toward said upper instrument mount, on said elongated member;

each of said upper support bars and said lower support bars, having an angled distal end, said angled distal end rotatable to a mounting position in front of a musical instrument to restrain it in said mounting cluster, said angled distal end rotatable to a removal position out of contact with said front of said musical instrument to allow removal of said musical instrument from said mounting cluster without having to adjust the distance between said upper instrument mount and said lower instrument mount; and whereby said musical instrument may be mounted to said stand by positioning said musical instrument between said upper support bars and said lower support bars and sliding said upper and lower instrument mounts toward each other to contact the side of said instrument wherein said upper and lower support bars may be rotated to position their respective angled ends in front of the front surface of said musical instrument to retain said musical instrument on said stand.

9. The musical instrument stand as defined in claim 8 further comprising:

each of said upper instrument mounts having at least one upper spacer bar, said upper spacer bar engaged at a first end with a spacer aperture located in said upper instrument mount, said upper spacer bar laterally translatable in said spacer aperture; and each of said lower instrument mounts having at least one lower spacer bar, said lower spacer bar engaged at a first end with a spacer aperture located in said lower instrument mount, said lower spacer bar laterally translatable in said spacer aperture.

10. The musical instrument stand as defined in claim 8 further comprising a means for insulation of said side surface of said musical instrument from contact with said upper and lower support bars during rotation of said upper and lower support bars.

11. The musical instrument stand as defined in claim 10 wherein said means for insulation of said side surface of said musical instrument from contact with said upper and lower support bars during rotation of said upper and lower support bars comprises an elongated cushion having an cushion aperture therethrough, said cushion positionable upon said upper and lower support bars by insertion of said support bars through said cushion aperture, said cushion aperture having a diameter slightly larger than the diameter of the support bar therein inserted, whereby said cushion will remain in substantially motionless contact with said musical instrument when said support bar is rotated.

* * * * *